United States Patent [19]

Condamines

[11] 3,940,560

[45] Feb. 24, 1976

[54] QUADRIPHONIC SOUND PICK-UP AND REPRODUCTION DEVICES

[75] Inventor: Roland J. Condamines, Chatillon-sous-Bagneux, France

[73] Assignee: Etablissement Public, Telediffusion de France, Paris, France

[22] Filed: Jan. 31, 1975

[21] Appl. No.: 545,831

[30] Foreign Application Priority Data

Jan. 31, 1974 France ..... 74.03269

[52] U.S. Cl. 179/1 GQ; 179/100.4 ST; 179/100.1 TD

[51] Int. Cl.[2]..... H04R 5/00

[58] Field of Search ..... 179/1 G, 1 GQ, 100.1 TD, 179/100.4 ST

[56] References Cited

UNITED STATES PATENTS 3,686,471 8/1972 Takahashi..... 179/1 G

FOREIGN PATENTS OR APPLICATIONS 984,601 4/1962 United Kingdom..... 179/1 G

OTHER PUBLICATIONS

Audio, Mar. 1961, Stage Sound, by Richard S. Levy, pp. 26–28 and 59.

IRE Transactions on Audio, Enhanced Stereo, by Benson, May–June 1961, pp. 63–65.

*Primary Examiner*—Douglas W. Olms

*Attorney, Agent, or Firm*—Abraham A. Saffitz

[57] ABSTRACT

A sound pick-up and reproducing system, comprising a first and a second pair of directional microphones respectively disposed at a first and a second given distance from the sonic scene to be transmitted, said second distance being greater than said first distance, said four microphones being closely coupled; the system is characterized in that the spacing between the microphones of the second pair is substantially less than that between the microphones of the first pair, and in that the angular divergence between the sound pick-up axes of the second pair is substantially less than the angular divergence between the sound pick-up axes of the first pair of microphones.

3 Claims, 7 Drawing Figures

QUADRIPHONIC SOUND PICK-UP AND REPRODUCTION DEVICES

Figure 1:
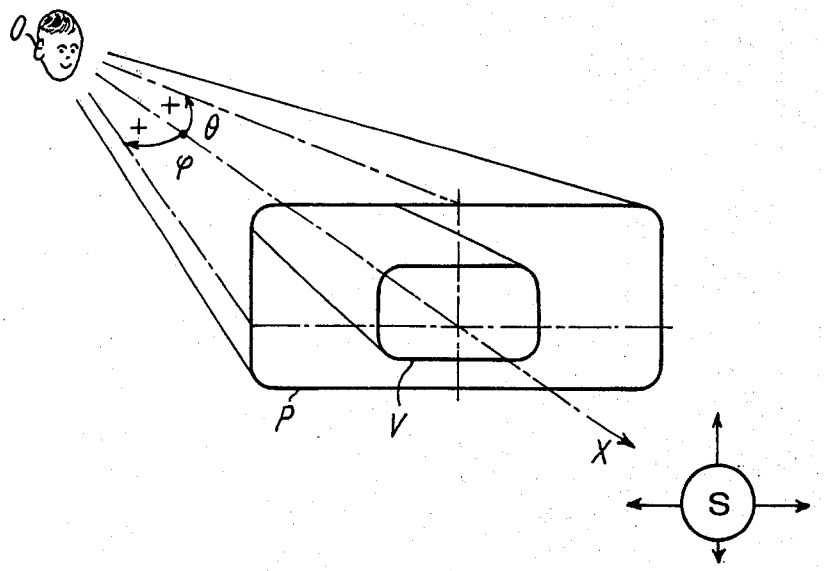

The invention relates in general to multiphonic sound, i.e. to electro-acoustic methods of sound pick-up and reproduction using a number of electro-acoustic channels processing separate signals. The invention more specifically relates to quadriphonic sound. The term "quadriphonic sound" used hereinafter denotes all methods and devices in which four separate transmission and/or recording channels are used for sound pick-up and playback, without all or any of the processed signals being intentionally mixed at any time so as to prevent the mixed signals from being efficiently separated.

For several years, those skilled in the art have been attempting to improve methods and devices which provide a listener to a broadcast or recorded concert with the illusion that the "sonic scene" (e.g. the orchestra or singers) is in front of him or, preferably, he himself is in the sound pick-up studio or the concert room. Naturally, attempts have been made to provide this additional illusion by increasing the number of pick-up, transmission and/or recording, and playback channels. Systems in present use are limited to four channels for practical reasons (e.g. difficulties in picking up the sound, the bulk and complexity of the playback equipment, the frequency passband, and the limitations of recording media).

Apparently, the prior-art systems are not satisfactory. In some systems, which are designed to provide true quadriphonic sound in the aforementioned sense, the pick-up and reproduction channels are separated as thoroughly as possible from each other. The result, as we shall see hereinafter, is that the listener has unpleasant sensations of breaks or discontinuities in the space of the sonic scene, which of course destroy the desired illusion. In other systems, an attempt is made to obviate these disadvantages by mixing some of the signals. In such cases, there is very low compatibility with stereophonic sound, and the result is usually less pleasing and less accurate than that obtained by ordinary stereophonic equipment.

It appears that the inventors of the known systems involving separate (i.e. completely separate) channels have not been aware of the psycho-acoustic conditions which will be explained hereinafter and which must be respected if it is desired to give an unitary impression of the sonic scene and of the concert-room environment. Those inventors, on the other hand, who have attempted more of less consciously to restore unity by mixing the low-frequency transmission and/or playback electric signals, have disregarded the fact that the mixture has nothing to do with the synthesis of the overall sonic phenomena reaching a person listening to a concert, the phenomena having been dissociated by a sound pick-up method based entirely on acoustic physics.

Of course, we are not concerned here with "decoding" methods or devices which are designed to extract additional quadriphonic information from a stereophonic recording, the additional information being "reproduced" by phase-shifting and mixing the two channels.

An object of the invention is to provide a truly multiphonic, inter alia quadriphonic, method and device for sound pick-up, wherein separate channels are used and electro-acoustic playback units are disposed so as to provide more realistic, vivid reproduction than ordinary stereophonic systems, while ensuring the necessary compatibility with existing stereophonic reproduction equipment.

Before describing the invention, comparing it with prior-art systems and attempting to explain the advance which has been achieved, we must first set out some psycho-acoustic principles; some of these are known but others have been discovered during research carried out by the Applicant.

Figure 2:
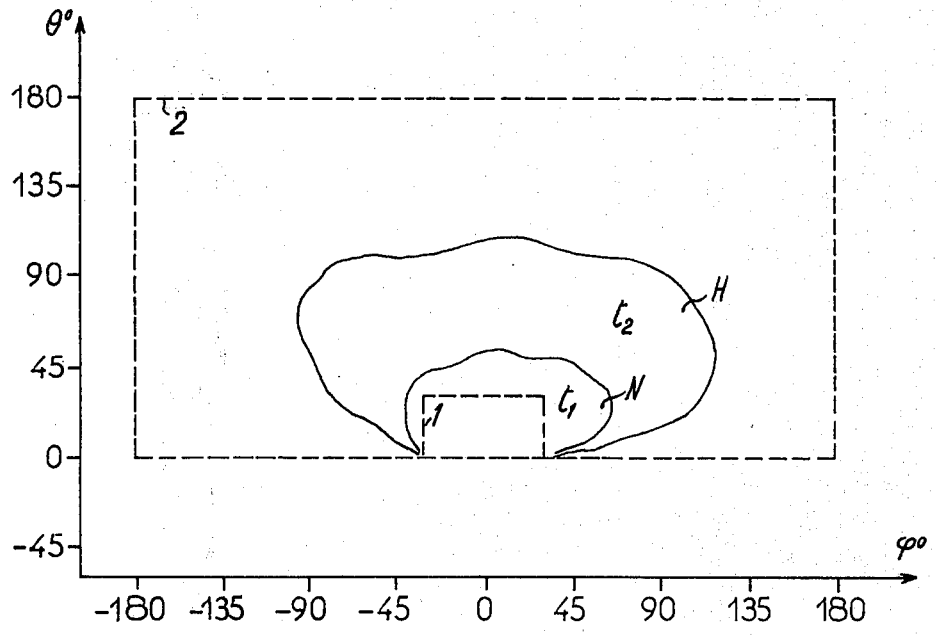
Figure 3A:
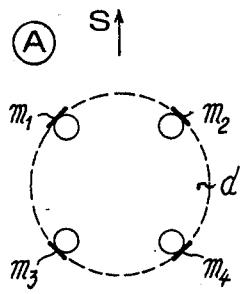
Figure 3B:
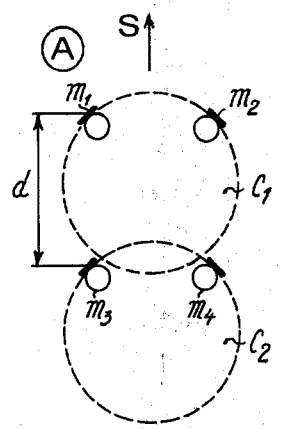
Figure 3C:
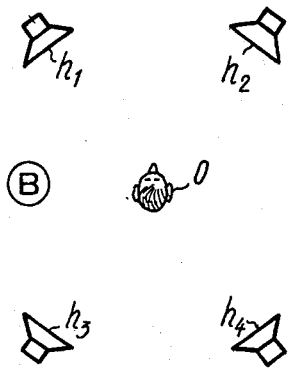
Figure 3D:
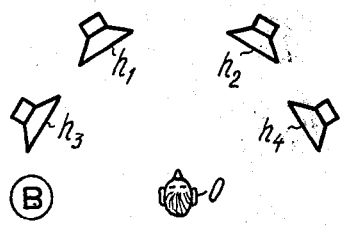
Figure 4:
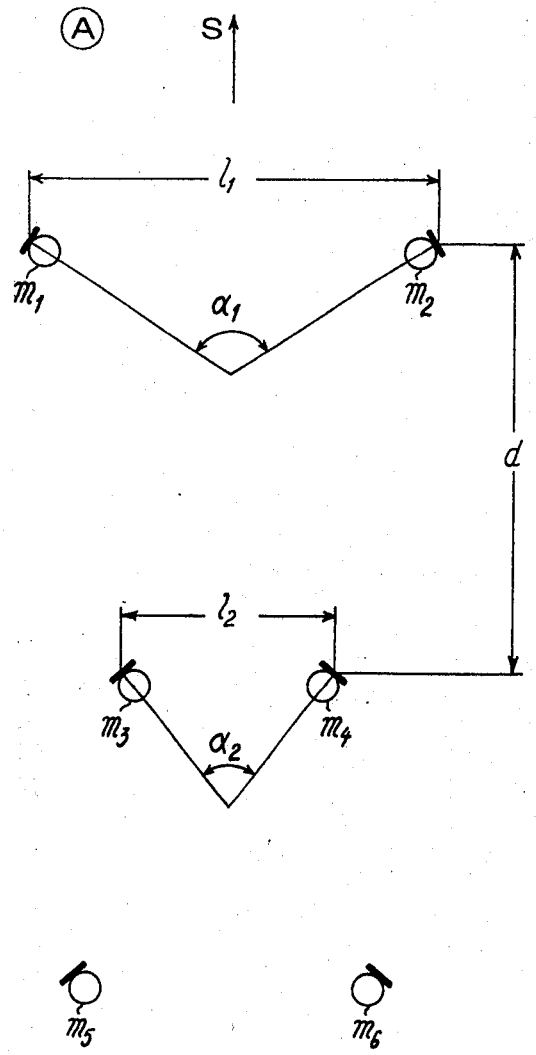

In the following description, we shall refer to the accompanying drawings in which:

FIGS. 1 and 2 show how the sonic subjective space appears to a listener;

FIGS. 3*a* to 3*d* diagrammatically show how microphones and loudspeakers are disposed in prior-art systems; and FIG. 4 diagrammatically shows how the microphones are disposed in the system according to the invention.

First, we shall define the term "sonic subjective space." A listener may be considered as the origin of the coordinates of a geometrical space which has the same limits as the concert room or the room where the listener is sitting. It has been found, however, that the same listener tends to locate his auditory perceptions in one or more regions of the space which are relatively closely associated with the sonic scene, his preceptions being relatively dissociated from their place of origin if the origin does not coincide with the sonic scene. In other words, the listener mentally superposes the physical space on a psycho-acoustic space which we shall hereinafter call the "sonic subjective space" and the coordinates of which are determined by the "place" where sonic or visual objects are perceived and attract the listener's attention.

In a concert room, for example, where the listeners' attention is acoustically and also visually attracted by the sonic scene, all acoustic phenomena (e.g. echoes from the back of the room) which can be attributed to the sonic scene, appear to come from the said scene, i.e. from the front. Likewise, a person in a room listening to a recorded or broadcast concert will project a sonic subjective space; one aim of a playback method, therefore, should be to help the listener to construct a subjective space which is as similar as possible to the space which he would construct in the concert room.

The term "sonic subjective space" can be more precisely understood by referring to FIG. 1. If the listener O is the origin, the reference coordinates of the subjective space can be represented by a horizontal plane and a vertical plane intersecting at an axis Ox coinciding with the axis of that region of the sonic scene to which the listener O is paying attention. The directions in which the listener is relatively attentive can be bounded by conical surfaces with the listener at the apex. In the present case, the term "conical surfaces" is taken in its most general sense, including e.g. pyramidal surfaces. We can therefore distinguish a presence cone P, inside which the listener spontaneously tends to locate all sonic phenomena which appear immediately connected with the sonic scene, and a vigilance cone V inside the presence cone, the vigilance cone being narrower and varying in direction depending on the part of the sonic scene on which the listener's attention is fixed. The width of cones P and V can be estimated from the values of their maximum angular widths along the sight direction $\theta$ and the azimuth direction $\phi$ along the vertical and horizontal reference planes.

The distinctions we have made may appear extremely summary, compared with the complexity and richness of the auditory perceptions and reactions of a listener, but they are a sufficient basis for the following arguments.

The subjective sonic space can be represented less concretely but more conveniently by considering its projection on a spherical surface surrounding the listener and applied to a plane. We then obtain a diagram of the kind shown in FIG. 2, wherein the angular coordinates $\theta$ and $\phi$ are referred to Cartesian axes in the plane of the drawing in a Mercator projection. Note that the general layout of the sonic scenes (e.g. the orchestral or operatic stage and the piano) is such that the presence region to be restored is considerably more extensive in the horizontal plane than in the vertical plane and is more extensive upwards that downwards. By way of example, we can say that an accurate stereophonic playback produces a presence region which is approximately inscribed in the contour 1 and that the aim of the inventors of the prior-art systems using four channels, whether separate or not, is to restore the entire surface 2.

After giving these preliminary definitions, we can say that an acoustic transmission and playback system should enable the listener, in the room where the reproduction is taking place, to form the same sonic subjective space as he would form in the room where the sound was picked up; i.e. the two subjective spaces should have the same extent and attract the listener's attention in the same manner. We must now, therefore, briefly analyse the characteristics of the sonic field which is directly heard, e.g. in a concert room. A given sound transmission coming from the sonic scene can be subjectively characterized, apart from any musical criterion, by its relief, i.e. by the manner in which it stands out from the sonic scene owing to the timbre, the entry of instruments, the intensity, etc, and owing to the time sequence in which perceptions occur. This time sequence is not only associated with the instant at which sound is received by the listener's ears. Actually, the relief and the time sequence are subjectively coordinated and we can say that the perception of a sound appears to be more rapid in proportion as the relief of the sound can be more easily distinguished from the sonic environment of the concert-room. Consequently, the physical distinction made in the conventional acoustics of rooms between direct sound and echoed sound cannot be directly applied to the problems of sonic perception. Instead, from a subjective point of view, it is necessary to distinguish the "core" from the "halo" of the sonic phenomenon in the sonic field perceived at a given instant by a listener.

The core involves not only the sound coming directly from the sonic scene, but also the first echoes from the room, i.e. the fraction of the sonic field which gives a direct, vivid auditory impression. The halo is made up of the other perceptible echoes and gives the effect of a sonic halo or corona which contributes to the impression of a more extensive environment. In short, the core corresponds to a time window relating to a period of perception $t1$ and the halo corresponds to a time window relating to a later period $t2$. Clearly, there is no discontinuity between the two time windows and there is a varying amount of interference between them.

In the subjective space in the diagram in FIG. 2, the core can be represented by a surface N also characterized by a dimension corresponding to the average time $t1$. The halo can be represented by a relatively limited region H of the diagram surrounding the core N and having an average time dimension $t2$, with $t2 > t1$ if the beginning of the perception of the sonic phenomenom is taken as the time origin.

We shall now, by briefly mentioning their main features, show why the various methods of true quadriphonic sound in present use cannot give satisfaction.

By way of example, FIGS. 3*a* and 3*b* show two methods of disposing microphones used for quadriphonic sound pick-up. A studio A contains the sonic scene S and four directional microphones m1-m4, which are usually having a cardioid characteristic. In FIG. 3*a*, the microphones are placed at the apices of a square and their diaphragms are directed towards the exterior of the square. The four microphones can be secured to a diffracting member or head C. In FIG. 3*b*, microphones *m*1 and *m*2 form a first stereophonic pair, which may or may not be mounted in a head C1, and *m*3 and *m*4 form a second pair and, if required, are mounted in a head C2. The spacing 1, e.g. 17 cm, between *m*1 and *m*2 is identical with the spacing between *m*3 and *m*4, and the distance *d* between the pairs is of the same order. All the diaphragms are obliquely oriented and face the sonic scene.

FIGS. 3*c* and 3*d* show how loudspeakers (or groups of loudspeakers) are disposed so as to reproduce the sounds picked up by microphones *m*1 to *m*4 respectively. Four loudspeaers *h*1 to *h*4 are respectively connected to the channels corresponding to microphones *m*1 to *m*4. It is assumed that the listener 0 is substantially in the center of the room B where sound is received. In FIG. 3*c*, the loudspeakers occupy the apices of a rectangle inscribed in the rectangle forming room B. In FIG. 3*d* they are all disposed in the front hemisphere of the listener's subjective space. The arrangements of microphones in FIGS. 3*a* and 3*b* do not give really satisfactory reception, whether they are associated with one or the other of the loudspeaker arrangements in FIGS. 3*c* and 3*d*.

We shall now analyse the impressions received and try to explain the causes thereof.

Aesthetically, the combination 3*a*–3*c* is the most defective. Microphones *m*1 and *m*2 form a stereophonic pair picking up the direct sound from sonic source S and microphones *m*3 and *m*4 form a second pair mainly picking up the echoed sound from the rear of studio A. The listener's attention is divided between the front group of loudspeakers and the rear group outside the presence cone, and he also has an unpleasant impression of lack of unity in the playedback sonic scene. This impression is reduced when all the loudspeakers are disposed in the front, as in FIG. 3*c*, *but groups* *h*3–*h*1, *h*1–*h*2 and *h*2–*h*4 form three stereophonic pairs corresponding to the stereophonic sound pick-up pairs *m*3–*m*1, *m*1–*m*2, *m*2–*m*4 and, if the listener turns his attention from the central pair, he may be attracted by one of the side pairs, in which case he experiences a sudden shift in the sonic scene.

Similar criticisms can be made with regard to the sound pick-up system in FIG. 3*b*, if used in combination either with the playback system in FIG. 3*c* or in FIG. 3*d*. The two pairs of microphones *m*1–*m*2 and *m*3–*m*4 have the same spacing and diverge in the same manner. In addition, the spacing between them is small. In the case of both loudspeaker arrangements, the listener perceives the complex received signal as if it came on the one hand from the loudspeaker group $h1$—$h3$ on the other hand from the group $h2$–$h4$. The impression is similar to that which would be given by a stereophonic system wherein the loudspeakers were too far apart.

Apparently, the defects in the prior-art systems are due to the fact that they are based on the distinction between direct and echoed sound (a physical distinction which does not allow for psycho-acoustic phenomena) so that the auditor's attention is equally attracted by the front and rear loudspeakers in FIG. 3*c* and by the central and side loudspeakers in FIG. 3*d*.

By contrast, the sound pick-up system according to the invention, diagrammatically shown in FIG. 4, is based on the psychoacoustic distinction between the sonic core and the sonic halo and is designed so that the listener's attention is captured by the central loudspeakers in FIG. 3*d*, i.e. so that the sound transmitted by the central loudspeakers, which determines the orientation of the presence cone, substantially corresponds to the sonic core, whereas the sound transmitted by the side loudspeakers corresponds to the halo. In the sound pick-up devices according to the invention, use is made (as in FIG. 3*b*) of two stereophonic pairs of directional microphones facing the sonic source, but there is a considerable difference between the position and orientation parameters of the microphones in the two pairs. If l1 is the distance between the pair of microphones nearer the sonic scene and l2 is the distance between the more remote pair of microphones, and $\alpha_1$ and $\alpha_2$ respectively are the divergence between the axes of the microphones in each pair, then, according to the invention, l2 is substantially less than l1 and $\alpha_2$ is substantially less than $\alpha_1$. The loudspeakers are disposed as in FIG. 3*d*. In addition:

- the distance d between the two pairs of microphones is between 45 and 65 cm and is advantageously of close to 55 cm;
- the distance l1 between the microphones in the first pair is between 15 and 20 cm, and is advantageously close to 17 cm;
- the angle of divergence $\alpha_1$ of the sound pick-up axes of the microphones in the first pair is between 90 and 120°, and is preferably substantially equal to 110°.

With regard to the corresponding parameters for the second pair of microphones, l2 is between 4 and 10 cm and is advantageously of the order of 6 cm and $\alpha_2$ is between 30 and 90° and is advantageously close to 60°. The parameters of the first pair of microphones are those which have been adopted to the Applicant for most stereophonic musical sound pick-ups.

In most cases, for reasons well known to the skilled addressee, the characteristics of the microphones should be cardioids. In some circumstances, however, where recording is difficult or where special effects are desired, some or all of the cardioid microphones may be replaced by more directional microphones or, on the contrary, by omni-directional microphones.

There are striking differences between the results obtained by the features acording to the invention and those obtained by the most similar prior-art features, as shown in FIG. 3*b*. The listeners who were selected as controls during a number of tests felt that the advance over ordinary stereophonic reproduction was as great as the advance of stereophonic over monoreproduction. Reception is spatially determined in the same manner as in stereophonic systems, but the environment is much more complete. The reasons for this may be explained as follows:

The front pair $m1$–$m2$ of microphones provides a conventional stereophonic pick-up. The rear pair $m3$–$m4$, which is considerably more distant, picks up practically the same sounds, but after an appreciable delay, and adds more echoes. Owing to this delay, which corresponds to the time difference ($t2$–$t1$) and which has been defined with reference to the subjective time windows corresponding to the sonic core and halo, the side loudspeakers appear to transmit the halo and consequently attract the listener's attention less than the central loudspeakers.

The playback characteristics are very sensitive to slight variations in the position of the rear pair of microphones, $m3$ and $m4$. If the rear pair is too near the front pair, the effects are observed which were mentioned in conjunction with FIG. 3*b*. If the rear pair of microphones are too near one another, or if their divergence is too small, the sound reproduced by the side loudspeakers becomes thinner and reduces the feeling of an environment and of space. If the rear microphones are too far away or diverge too much, there appears to be a dissociation between the accurate reproduction by the central loudspeakers and the fuzzy reproduction by the side loudspeakers, and the sonic scene loses its unity.

The ranges previously given for the different parameters $d$, l1, l2, $\alpha_1$ and $\alpha_2$ are adequate in practice for all problems relating to sound pick-up. In most cases, however, it is advantageous to adopt the recommended preferential values.

Tests have shown that is is usually necessary for all the loudspeakers to be disposed in the front hemisphere of the reception space. If the loudspeakers corresponding to microphones $m3$ and $m4$ moved backwards, they produce the unpleasant feeling of dissociation which has already been mentioned. In this case, however, a pleasant impression can be given by ensuring that the axis of the rear loudspeakers does not point directly towards the listener.

Finally, during tests in the course of development of the system according to the invention, the Applicant examined the conditions which must be satisfied by a multiphonic system using more than four separate channels. It was found that the best results are obtained when a pair of microphones $m5$–$m6$ or a succession of such pairs is disposed behind the pair $m3$–$m4$, microphones $m5$–$m6$ being substantially further apart than microphones $m3$–$m4$, and the spacing between the subsequent pairs increasing in proportion to their distance from the sonic scene. With regard to the corresponding side loudspeakers, their distance from the reception axis should vary in direct proportion to the distance between the sonic scene and the pair of microphones.

What I claim is:

1. A sound pick-up device for multiphonic broadcasting and recording, comprising a first stereophonic pair of directional microphones disposed at a first given distance from a sonic scene to be transmitted and having a second stereophonic pair of directional microphones disposed at a second given distance from said sonic scene, said second distance being greater than said first distance by a quantity $d$, each microphone having a sound pick-up axes, the four microphones being disposed so that the spacing l2 between the microphones of the second pair is substantially less than the spacing l1 between the microphones of the first pair, and the angle of divergence $\alpha_2$ of the sound pick-up axes of the second pair of microphones in the direction of the sonic scene is substantially less than the angle of divergance $\alpha_2$ of the sound pick-up axes of the first pair of microphones; said device being characterized in that each of said pairs of microphones is arranged symmetrically with respect to a median vertical plane of said sonic scene.

2. A multiphonic sound transmission system, using a sound pick-up device in accordance with claim 1, in which the sound pick-up signals from the four microphones are reproduced respectively by two pairs of electro-acoustic playback units disposed in the front hemisphere of a reception space and at unequal distances from the axis of said space, the two playback units nearer the axis of said reception space respectively reproducing the sound picked-up by the microphones of said first pair and the two playback units further away from said axis respectively reproducing the sound picked-up by the microphones of said second pair.

3. A multiphonic sound transmission system according to claim 1, using a third pair of microphones which are more distant from the sonic scene than said second pair, in which the spacing between the microphones of said third pair is substantially greater than that between the microphones of the second pair, and in which the sounds picked-up by the microphones of said third pair are respectively reproduced by two additional playback units disposed one on either side of the playback units corresponding to said second pair of microphones.

* * * * *